US012428939B2

(12) United States Patent
Asiri et al.

(10) Patent No.: US 12,428,939 B2
(45) Date of Patent: Sep. 30, 2025

(54) REMEDIATING FAILED ISOLATION IN PLUG-AND-PERFORATION OPERATIONS

(71) Applicant: Saudi Arabian Oil Company, Dhahran (SA)

(72) Inventors: Mohammed A. Asiri, Al Salmaniyah (SA); Abdulrahman A. Al-Mulhim, Al Salmaniyah (SA); Sultan S. AlOtaibi, Al-Kharj (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/588,998

(22) Filed: Feb. 27, 2024

(65) Prior Publication Data

US 2025/0270904 A1 Aug. 28, 2025

(51) Int. Cl.

| | |
|---|---|
| ***E21B 47/06*** | (2012.01) |
| ***E21B 33/124*** | (2006.01) |
| ***E21B 43/119*** | (2006.01) |

(52) U.S. Cl.

CPC ..... *E21B 43/119* (2013.01); *E21B 33/124* (2013.01); *E21B 47/06* (2013.01)

(58) Field of Classification Search

CPC ..... E21B 33/12; E21B 33/134; E21B 43/11; E21B 43/119; E21B 47/06

See application file for complete search history.

(56) References Cited

U.S. PATENT DOCUMENTS

| | | | | |
|---|---|---|---|---|
| 9,574,443 | B2 * | 2/2017 | Walters | E21B 47/06 |
| 12,006,819 | B2 * | 6/2024 | Cramer | E21B 43/11 |
| 2005/0230117 | A1 * | 10/2005 | Wilkinson | E21B 33/138 166/308.1 |
| 2017/0114613 | A1 * | 4/2017 | Lecerf | E21B 43/26 |
| 2020/0362669 | A1 * | 11/2020 | Roussel | E21B 41/00 |
| 2021/0332684 | A1 * | 10/2021 | Madasu | E21B 43/26 |
| 2021/0388704 | A1 * | 12/2021 | Montgomery | C09K 8/62 |
| 2022/0003229 | A1 * | 1/2022 | Mu | F04B 17/06 |
| 2022/0056793 | A1 * | 2/2022 | Korkin | E21B 47/00 |
| 2022/0215156 | A1 * | 7/2022 | Roussel | E21B 43/26 |

* cited by examiner

*Primary Examiner* — Angela M DiTrani Leff
(74) *Attorney, Agent, or Firm* — Fish & Richardson P.C.

(57) ABSTRACT

Method for detecting and remediating plug failure during plug-and-perforation operations can include forming perforations the casing of a wellbore at an first stage; recording instantaneous shut-in pressure (ISIP) of an injection test at the first stage ($ISIP_{STG(N)_INJ}$); recording ISIP of fracking operations at the first stage ($ISIP_{STG(N)_FRAC}$); setting a plug uphole of the perforations and downhole of planned perforations for a second stage; recording ISIP of an injection test at the second stage ($ISIP_{STG(N+1)_INJ}$); determining the plug has failed if $ISIP_{STG(N+1)_INJ} \leq ISIP_{STG(N)_INJ}$ and $ISIP_{STG(N+1)_INJ} \leq ISIP_{STG(N)_FRAC}$); based on determining the plug has failed, calculating a volume of communication between the first stage and the second stage; pumping a fluid carrying powdered palm tree leaves downhole while measuring surface pressure until the surface pressure stops increasing; and forming perforations the casing of a wellbore at the second stage.

14 Claims, 4 Drawing Sheets

REMEDIATING FAILED ISOLATION IN PLUG-AND-PERFORATION OPERATIONS

TECHNICAL FIELD

This specification relates to plug-and-perforation operations, particularly to identifying and remediating failed zonal isolation in plug-and-perforation operations.

BACKGROUND

Plug-and-perforation operations are an approach used in the oil and gas industry for stimulating (e.g., fracturing) wellbores, particularly horizontal wellbores. Plug-and-perforation operations can enable stimulating wellbores in a number of stages rather than all at once. This is significant because horizontal wellbores can extend significant distances into a formation with the length that is too great to be effectively stimulated in a single stage.

For example, a perforation tool can be run downhole and operated to form perforations near the end of a cased wellbore. Fracturing fluid can be pumped downhole to fracture the formation in the vicinity of the initial perforations. After this initial simulation, a plug is set uphole of initial perforations and downhole of the planned perforations for the next stage. Setting the plug isolates a previous stage from the following stage planned for perforation and stimulation providing zonal isolation between the stages. When zonal isolation is achieved, stimulating fluids pumped into the wellbore after perforating the planned stage only go to the current perforated zone, increasing the likelihood of effective stimulation.

The perforation, stimulation, plug setting cycle is repeated retreating uphole until all planned stages have been stimulated.

SUMMARY

This specification describes an approach to identifying and remediating failed zonal isolation in plug-and-perforation operations. This approach can use examination and comparison of the instantaneous shut-in pressure (ISIP) value of a current stage to the previous stage's value. If plug failure is detected, this approach can include estimating the volume of the space around the plug allowing communication between stages which causes the plug failure.

In addition, the failure can be remediated by pumping remediation materials downhole in a carrying fluid. In some cases, the remediation materials can include palm tree dry leaf powder. The volume of remediation materials can be estimated based on the volume of the space around the plug allowing communication between stages.

The approach disclosed in this specification can be used to provide zonal isolation in the vicinity of a failed plug without time and cost of running a second plug downhole to the failed plug.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

This specification describes an approach to identifying and remediating failed zonal isolation in plug-and-perforation operations. This approach can use examination and comparison of the instantaneous shut-in pressure (ISIP) value of a current stage to the previous stage's value. If plug failure is detected, this approach can include estimating the volume of the space around the plug allowing communication between stages which causes the plug failure.

In addition, the failure can be remediated by pumping remediation materials downhole in a carrying fluid. In some cases, the remediation materials can include palm tree dry leaf powder. The use of palm tree dry leaf is advantageous due to the abundancy of the dry leaf in comparison with the marble particles, calcium carbonate flakes, date palm tree fibers, and date seed particles. In addition, dry leaf exists in nature in a large size which can be modified from macro to nano scales depending on the needs of a particular situation. The volume of remediation materials can be estimated based on the volume of the space around the plug allowing communication between stages.

Figure 1:
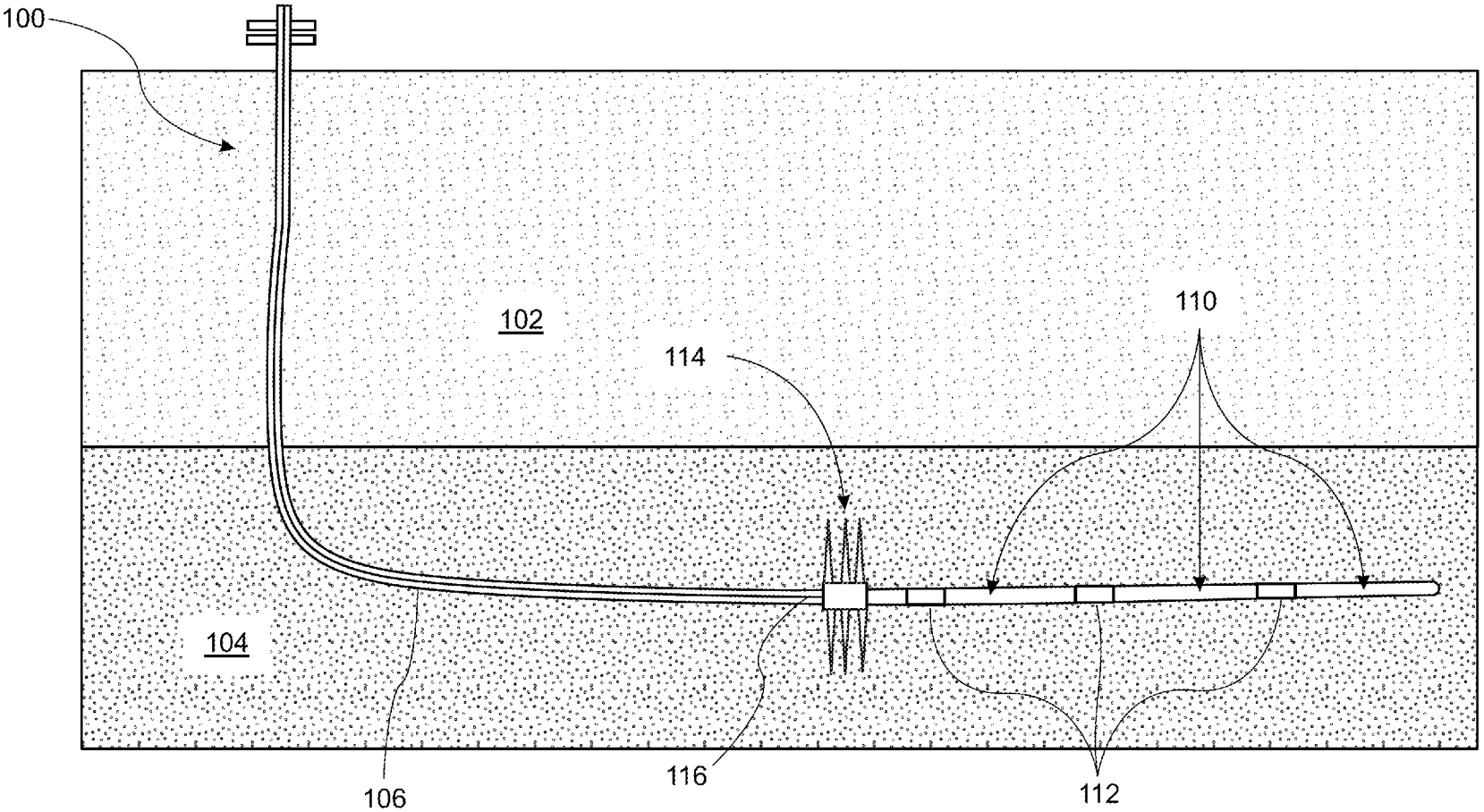
FIG. 1 is a schematic view of a plug-and-perforation operation being performed in a well.

FIG. 1 is a schematic view of a plug-and-perforation operation being performed in a well 100. The well 100 has been drilled through an overburden layer 102 and extended horizontally into a formation 104 containing hydrocarbons with a casing 106 installed and cemented. Perforations 110 have been formed through the casing 106 in the three furthest downhole stages of the well 100. Each stage of the well 100 is separated from the subsequent stage by a plug 112.

After a stage has been perforated and fracked, a wireline assembly can be used to run a bottom hole assembly 114 with a plug 112 and a perforation tool 116 downhole. The plug 112 is set to isolate the completed stage from the next stage being worked. Once the plug 112 is set in place, the bottom hole assembly is released from the plug.

If the plug 112 does not completely isolate the current zone from the previous zone, the subsequent fracking will be less effective due to the fracking fluid and being applied to more than one zone. The approach to identifying and remediating failed zonal isolation described in this specification can reduce the likelihood of this problem occurring. Before perforating the current stage, operators examine and compare the instantaneous shut-in pressure value of a current stage to the previous stage's value. If plug failure is detected, the failure can be remediated by pumping remediation materials downhole in a carrying fluid.

When the zonal isolation has been provided (e.g., by successfully setting the plug 112 or identifying and remediating a zonal isolation failure), the perforation tool 116 is positioned at the location perforations are desired in the current stage. Once in place, the perforation tool 116 is fired to form a new set of perforations through the liner 106 and the cement into the formation 104. The type and number of guns per stage, the shot density, phasing and number of shots are determined by the completion design.

This process is repeated until all zones along the horizontal section of the well bore have been fracked and the wellbore is completed. Once fracking is complete, the plugs are removed (e.g., drilled out or dissolved) before beginning production.

Figure 2:
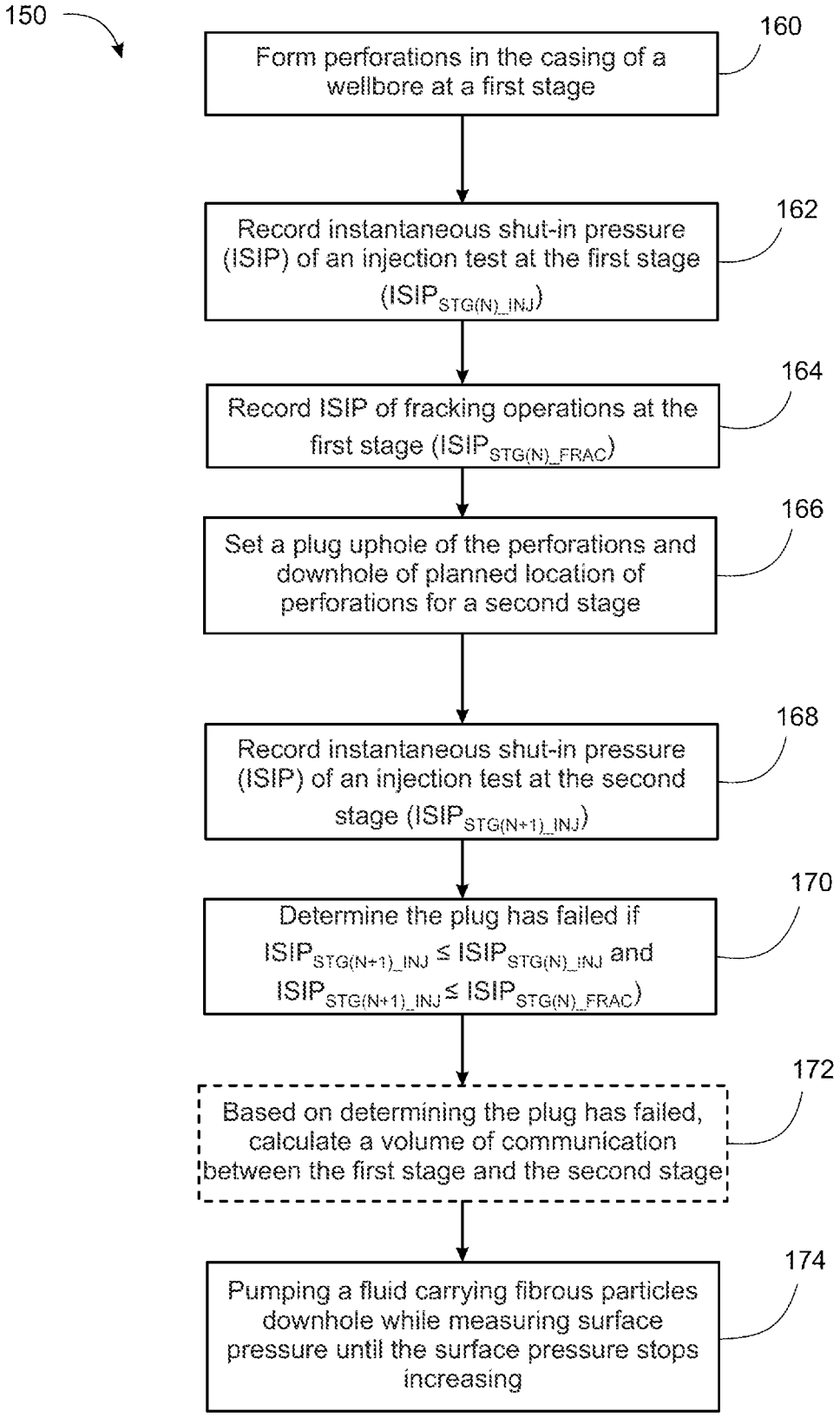
FIG. 2 is a flowchart of a method of remediating failed zonal isolation between stages of a plug-and-perforation operation.

FIG. 2 is a flowchart of a method 150 of remediating failed zonal isolation between stages of a plug-and-perforation operation. The steps of the method 150 are described with reference to the system components shown in FIG. 1.

Perforations are in the casing 106 of a well 100 at a first stage of the well 100 (step 160). The terms "first stage" and "second stage" are used to indicate a specific stage of the well and the next adjacent uphole stage. An injection test is then performed at the first stage of the well 100. For example, injection tests can be carried out by injecting liquids such as fresh water, treated water, formation-friendly chemicals into the formation at highest rate possible with respect to the maximum allowable pressure for well's completion and surface equipment. The test is concluded when stable pressure and injection rate are observed. The instantaneous shut-in pressure (ISIP) measured by the injection test at the first stage ($ISIP_{STG(N)_INJ}$) is recorded (step 162) for use in assessing the plug 112 that will be installed between the first stage and the second stage.

After testing, fracking operations are conducted at the first stage of the well 100. The ISIP of fracking operations at the first stage ($ISIP_{STG(N)_FRAC}$) is recorded (step 164). Typically, the ISIP is measured by reading the surface pressure upon shutting down the pumping equipment.

After fracking operations are complete, a plug 112 is set uphole of the perforations 110 and downhole of planned location for the perforations 110 for a second stage (step 166).

An injection test is then performed at the second stage of the well 100 and the ISIP measured by the injection test at the second stage ($ISIP_{STG(N+1)_INJ}$) is recorded (step 168). The plug 112 between the first stage and the second stage is then assessed by comparing the ISIP measured by the injection test at the first stage ($ISIP_{STG(N)_INJ}$) and ISIP of fracking operations at the first stage ($ISIP_{STG(N)_FRAC}$) with the ISP of the injection test at the second stage ($ISIP_{STG(N+1)_INJ}$). If both are higher than the ISP of the injection test at the second stage (i.e., $ISIP_{STG(N+1)_INJ} \leq ISIP_{STG(N)_INJ}$ and $ISIP_{STG(N+1)_INJ} \leq ISIP_{STG(N)_FRAC}$), it is determined that the plug 112 has failed (step 170). In some implementations, it is determined that the plug 112 has failed if $ISIP_{STG(N+1)_INJ} \leq ISIP_{STG(N)_INJ}$ or $ISIP_{STG(N+1)_INJ} \leq ISIP_{STG(N)_FRAC}$ but using both criteria provides more accurate results (e.g., fewer false positives).

Figure 3A:
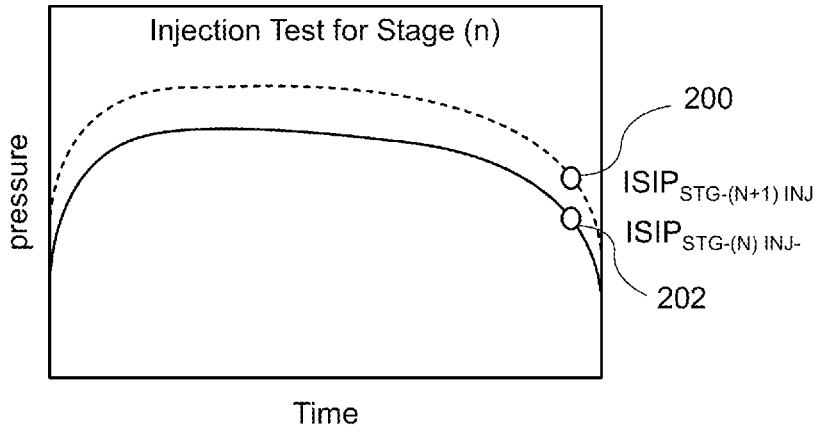
FIG. 3A and FIG. 3B are pressure-time charts illustrating the identification of failed zonal isolation between stages of a plug-and-perforation operation.
Figure 3B:
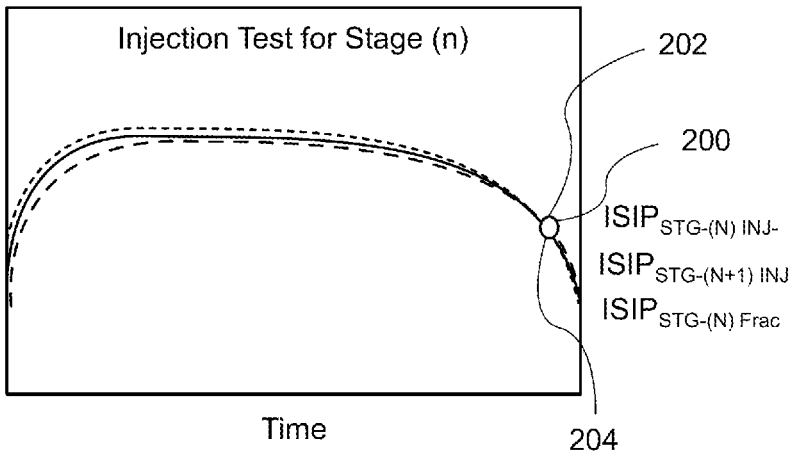

FIG. 3A and FIG. 3B are pressure-time charts illustrating the identification of failed zonal isolation between stages of a plug-and-perforation operation. In FIG. 3A, the ISIP 200 measured by the injection test at the second stage (ISIPSTG(N+1)_INJ) is greater than the ISIP 202 measured by the injection test at the first stage (ISIPSTG(N)_INJ). This indicates that the plug is holding and free of failure. There is no need to for a further check against the ISIP of fracking operations at the first stage (ISIPSTG(N)¬_FRAC). In FIG. 3B, the ISIP 200 measured by the injection test at the second stage (ISIPSTG(N+1)_INJ), the ISIP 202 measured by the injection test at the first stage (ISIPSTG(N)_INJ), and the ISIP 204 of fracking operations at the first stage (ISIPSTG(N)¬_FRAC) are all approximately equal. This indicates that the plug has failed.

Referring again to FIG. 2, if the plug has failed, a volume of communication between the first stage and the second stage can be calculated (step 172) to provide an estimate of the amount of remediation material necessary to close spaces between the plug and the well casing. Calculating the volume of communication and using the estimate to guide the amount of remediation material pumped downhole can help avoid adding excessive remediation material that could plug the hole.

Figure 4:
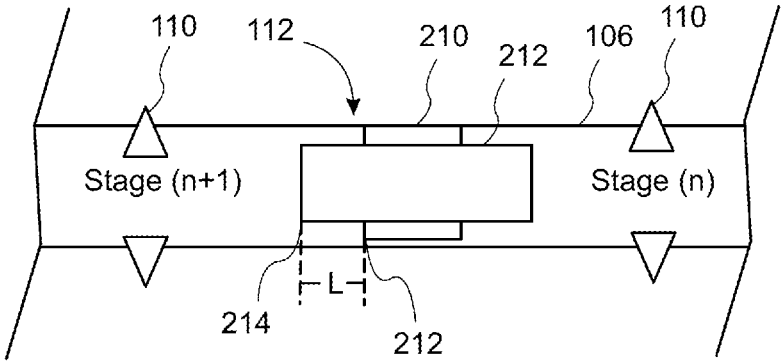
FIG. 4 is a schematic view of a failed plug.

FIG. 4 is a schematic view of a plug 112 between a first stage (e.g., stage (n)) and a second stage (n+1) that has failed. The plug 112 includes slips 210 extending from a body 212. Although some of the slips 210 have engaged the casing 106 and formed a seal, some of the slips 210 have not fully extended allowing fluid to flow from the second stage (n+1) to the first stage (n)). One approach to calculating the volume of communication between the first stage and the second stage is to multiply a length L of between a top 214 of slips of the plug and a top 216 of the body of the plug times an annular capacity of the wellbore between the plug and the casing of the wellbore.

Referring again to FIG. 2, after a volume of communication is calculated (if this calculation is performed), a fluid carrying fibrous particles is pumped downhole while measuring surface pressure until the surface pressure stops increasing (step 174).

Figure 5:
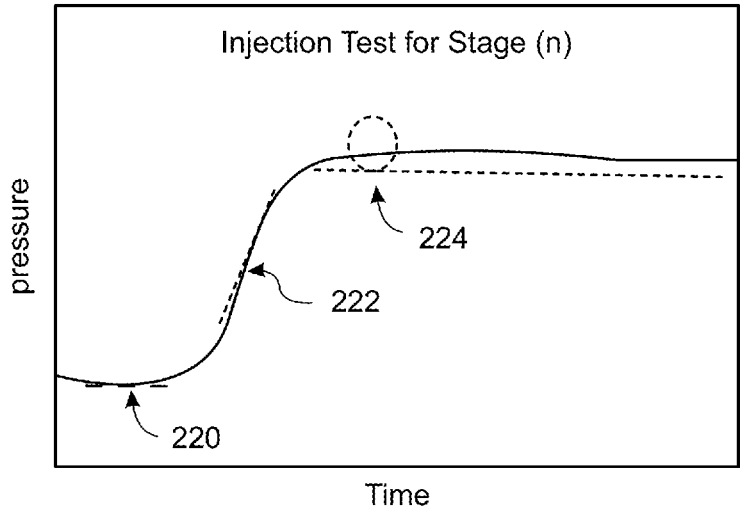
FIG. 5 is a pressure-time chart illustrating the identification of remediation of failed zonal isolation between stages of a plug-and-perforation operation.

FIG. 5 is a pressure-time chart illustrating the identification of remediation of failed zonal isolation between stages of a plug-and-perforation operation. Initially, surface pressure continues to behave similarly to the performed injection test which identified the plug failure was observed (region 220). As the mixture approaches the point of failure in the plug, surface pressure increases in response to the accumulation of the remediation material in the space between the plug and casing(region 222). The pressure derivative during this phase indicates the effectiveness of zonal isolation. As pumping progresses, surface pressure increases as an indication of developing zonal isolation between stage (n) and stage (n+1). Eventually, a maximum pressure point (region 224).

In some approaches, the fibrous particles are based on powdered palm tree leaves. The use of palm tree's dry leaf powder to seal the space around the plug can be effective as the fibrous nature of the powder allows it to accumulate into micro spaces without being soluble in water or formation fluid. As it is solid, the fibrous material needs a carrying fluid to transport it from the surface to the point of failure. For example, the carrying fluid can be water treated with bactericide or a linear gel. In some cases, fluid carrying fibrous particles is pumped downhole until the volume of the fibrous particles pumped downhole is at least equal to the volume of communication between the first stage and the second stage.

One approach to pumping the fibrous material downhole is to identify a viscosity of the fluid carrying the fibrous particles that can be pumped downhole without exceeding a maximum allowable pressure of the wellbore. This can be done by identifying the viscosity of the fluid as determined using a viscometer and determining maximum allowable pressure of the wellbore based on pumping simulation software that embed empirical correlations. The correlations use viscosity as a main input to output estimated maximum surface pressure during pumping. Laboratory test can be run to determine a maximum concentration of the fibrous particles in the fluid at the identified viscosity. For example, this can be done by mixing different concentrations of the particles with the same volume of clean fluid to define the highest concentration of particles that can be mixed with the clean fluid without causing the new mixture to be semi-solid instead of liquid. Semi-solids can't be pumped into wells. After the desired amount of remediation material has been pumped downhole, the injection is switched to clean fluid. The clean fluid will chase away the mixture to the point of interest down the well.

After remediation, the process can be repeated by forming perforations in the casing of a wellbore at the current stage and fracking the current stage before setting another plug.

EXAMPLES

In some implementations, methods for detecting and remediating plug failure during plug-and-perforation operations include: forming perforations in the casing of a wellbore at an first stage; recording instantaneous shut-in pressure (ISIP) of an injection test at the first stage ($ISIP_{STG(N)_INJ}$); recording ISIP of fracking operations at the first stage ($ISIP_{STG(N)_FRAC}$); setting a plug uphole of the perforations and downhole of a planned location for perforations for a second stage; recording ISIP of an injection test at the second stage ($ISIP_{STG(N+1)_INJ}$); determining the plug has failed if $ISIP_{STG(N+1)_INJ} \leq ISIP_{STG(N)_INJ}$ and $ISIP_{STG(N+1)_INJ} \leq ISIP_{STG(N)_FRAC}$); based on determining the plug has failed, calculating a volume of communication between the first stage and the second stage; and pumping a fluid carrying fibrous particles downhole while measuring surface pressure until the surface pressure stops increasing.

In some implementations, methods for detecting and remediating plug failure during plug-and-perforation operations include: forming perforations the casing of a wellbore at an first stage; recording instantaneous shut-in pressure (ISIP) of an injection test at the first stage ($ISIP_{STG(N)_INJ}$); recording ISIP of fracking operations at the first stage ($ISIP_{STG(N)_FRAC}$); setting a plug uphole of the perforations and downhole of planned perforations for a second stage; recording ISIP of an injection test at the second stage ($ISIP_{STG(N+1)_INJ}$); determining the plug has failed if $ISIP_{STG(N+1)_INJ} \leq ISIP_{STG(N)_INJ}$ and $ISIP_{STG(N+1)_INJ} \leq ISIP_{STG(N)_FRAC}$); based on determining the plug has failed, calculating a volume of communication between the first stage and the second stage; pumping a fluid carrying powdered palm tree leaves downhole while measuring surface pressure until the surface pressure stops increasing; and forming perforations the casing of a wellbore at the second stage.

In an example implementation combinable with any other example implementation, the fibrous particles includes powdered palm tree leaves. In some cases, pumping the fluid carrying the fibrous particles downhole includes pumping the fluid carrying a volume of the fibrous particles at least equal to the volume of communication between the first stage and the second stage.

In an example implementation combinable with any other example implementation, methods also include identifying a viscosity of the fluid carrying the fibrous particles that can be pumped downhole without exceeding a maximum allowable pressure of the wellbore.

In an example implementation combinable with any other example implementation, methods also include determining a maximum concentration of the fibrous particles in the fluid at the identified viscosity.

In an example implementation combinable with any other example implementation, the fluid includes water treated with bactericide.

In an example implementation combinable with any other example implementation, the fluid includes a linear gel.

In an example implementation combinable with any other example implementation, methods also include forming perforations the casing of a wellbore at the second stage.

In an example implementation combinable with any other example implementation, calculating the volume of communication between the first stage and the second stage includes multiplying a length of between a top of slips of the plug and a top of the body of the plug times an annular capacity of the wellbore between the plug and the casing of the wellbore.

A number of embodiments of the systems and methods have been described. Nevertheless, it will be understood that various modifications may be made without departing from the spirit and scope of this specification. Accordingly, other embodiments are within the scope of the following claims.

What is claimed is:

1. A method for detecting and remediating plug failure during plug-and-perforation operations, the method comprising:

forming perforations in a casing of a wellbore at a first stage;

recording instantaneous shut-in pressure (ISIP) of an injection test at the first stage ($ISIP_{STG(N)_INJ}$);

recording ISIP of fracking operations at the first stage ($ISIP_{STG(N)_FRAC}$);

setting a plug uphole of the perforations and downhole of a planned location for perforations for a second stage;

recording ISIP of an injection test at the second stage ($ISIP_{STG(N+1)_INJ}$);

determining the plug has failed if $ISIP_{STG(N+1)_INJ} \leq ISIP_{STG(N)_INJ}$ and $ISIP_{STG(N+1)_INJ} \leq ISIP_{STG(N)_FRAC}$;

based on determining the plug has failed, calculating a volume of communication between the first stage and the second stage and pumping a fluid carrying fibrous particles downhole while measuring increases in surface pressure until the surface pressure stops increasing.

2. The method of claim 1, wherein the fibrous particles comprises powdered palm tree leaves.

3. The method of claim 2, wherein pumping the fluid carrying the fibrous particles downhole comprises pumping the fluid carrying a volume of the fibrous particles equal to the volume of communication between the first stage and the second stage.

4. The method of claim 3, further comprising identifying a viscosity of the fluid carrying the fibrous particles that can be pumped downhole without exceeding a maximum allowable pressure of the wellbore.

5. The method of claim 4, further comprising determining a maximum concentration of the fibrous particles in the fluid at the identified viscosity.

6. The method of claim 1, wherein the fluid comprises water treated with bactericide.

7. The method of claim 1, wherein the fluid comprises a linear gel.

8. The method of claim 1, further comprising forming perforations in the casing of the wellbore at the second stage.

9. A method for detecting and remediating plug failure during plug-and-perforation operations, the method comprising:

forming perforations in a casing of a wellbore at a first stage;

recording instantaneous shut-in pressure (ISIP) of an injection test at the first stage ($ISIP_{STG(N)_INJ}$);

recording ISIP of fracking operations at the first stage ($ISIP_{STG(N)_FRAC}$);

setting a plug uphole of the perforations and downhole of planned perforations for a second stage;

recording ISIP of an injection test at the second stage ($ISIP_{STG(N+1)_INJ}$);

determining the plug has failed if $ISIP_{STG(N+1)_INJ} \leq ISIP_{STG(N)_INJ}$ and $ISIP_{STG(N+1)_INJ} \leq ISIP_{STG(N)_FRAC}$;

based on determining the plug has failed, calculating a volume of communication between the first stage and the second stage and pumping a fluid carrying powdered palm tree leaves downhole while measuring increases in surface pressure until the surface pressure stops increasing; and forming perforations in the casing of the wellbore at the second stage.

10. The method of claim 9, wherein pumping the fluid carrying the powdered palm tree leaves downhole comprises pumping the fluid carrying a volume of the powdered palm tree leaves equal to the volume of communication between the first stage and the second stage.

11. The method of claim 10, further comprising identifying a viscosity of the fluid carrying the powdered palm tree leaves that can be pumped downhole without exceeding a maximum allowable pressure of the wellbore.

12. The method of claim 11, further comprising determining a maximum concentration of the powdered palm tree leaves in the fluid at the identified viscosity.

13. The method of claim 9, wherein the fluid comprises water treated with bactericide.

14. The method of claim 9, wherein the fluid comprises a linear gel.

* * * * *